US009498664B2

(12) United States Patent
Lorentz, II

(10) Patent No.: US 9,498,664 B2
(45) Date of Patent: Nov. 22, 2016

(54) FOOT, LEG AND ARM SUPPORT FOR EXERCISE

(76) Inventor: Robert A. Lorentz, II, Wasilla, AK (US)

( * ) Notice: Subject to any disclaimer, the term of this patent is extended or adjusted under 35 U.S.C. 154(b) by 1103 days.

(21) Appl. No.: 13/134,991

(22) Filed: Jun. 21, 2011

(65) Prior Publication Data

US 2012/0329621 A1 Dec. 27, 2012

(51) Int. Cl.

| | |
|---|---|
| ***A63B 23/035*** | (2006.01) |
| ***A63B 21/00*** | (2006.01) |
| ***A63B 21/055*** | (2006.01) |
| ***A63B 22/00*** | (2006.01) |

(52) U.S. Cl.

CPC ..... *A63B 21/00047* (2013.01); *A63B 21/0552* (2013.01); *A63B 21/4029* (2015.10); *A63B 21/4033* (2015.10); *A63B 22/0007* (2013.01); *A63B 2225/093* (2013.01)

(58) Field of Classification Search

CPC ..... A63B 21/4033; A63B 21/4034; A63B 21/4035; A63B 21/4039; A63B 21/00047

USPC ..... 482/79, 142, 132, 145, 62, 92, 44–50; 602/4–5, 23; 601/5, 23–24, 27, 32–35

See application file for complete search history.

(56) References Cited

U.S. PATENT DOCUMENTS

| | | | | |
|---|---|---|---|---|
| 71,775 | A * | 12/1867 | Mattson | 482/92 |
| 607,666 | A * | 7/1898 | Smith | A61F 5/0585 602/5 |
| 661,812 | A * | 11/1900 | McKown | A61G 13/0036 602/36 |
| 3,623,445 | A * | 11/1971 | Holmes | 114/204 |
| 4,358,125 | A * | 11/1982 | Charles | 280/250.1 |
| 7,645,218 | B2 * | 1/2010 | Potok | A63B 23/1245 482/139 |
| 8,057,370 | B2 * | 11/2011 | Dunn | A63B 21/0552 482/121 |
| 2008/0076641 | A1 * | 3/2008 | Sheehan | A63B 21/0552 482/92 |
| 2010/0105532 | A1 * | 4/2010 | Israeli | 482/131 |

* cited by examiner

*Primary Examiner* — Loan H Thanh
*Assistant Examiner* — Rae Fischer
(74) *Attorney, Agent, or Firm* — Michael J. Tavella

(57) ABSTRACT

A foot/leg/arm rest that is fully height and width adjustable. In addition, support cups can be positioned over a wide range of fixed angles to accommodate any user. The supports have a wide base that provides strong, firm and stable support for the device when it is used. The invention has two horizontal end members and a central connecting track. Two vertical post supports are positioned in the track and are slidably installed so that they can be positioned at any desired location within the track. In fact, one of the posts can be removed if desired so that only one post is in use. Each post is height adjustable independent of the other. This allows that supports to be positioned at two different levels, if desired. Each post has a support secured to it using a bracket that can be set to a wide range of angles.

10 Claims, 9 Drawing Sheets

FOOT, LEG AND ARM SUPPORT FOR EXERCISE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to foot, leg and arm supports and particularly to foot, leg and arm supports for use in exercise.

2. Description of the Prior Art

There are many types of exercise today that require a person to rest partially on the toes. Several types of exercises are best done with the feet and legs elevated. Moreover, there are certain types of exercises that require a user to rest on their forearms or elbows, such as an exercise called "the plank". These exercises can be done by healthy individuals with no problems. However, for people with conditions such as gout, neuropathy, or other similar conditions, resting one's weight on the feet or elbows can be painful to the point where such exercises are difficult, if not impossible to do.

It is also true that for many healthy exercises, making standard exercises more difficult by raising the legs or the upper body has long been known. Typically, many people use benches, chairs or other similar items to accomplish this. While useful, these items are not ideal. Benches and chairs can move, causing a user to fall and become injured. Benches and chairs are also usually fixed height making them less adaptable for variations in body size. Therefore, benches and chairs are not ideal for use with alternative types of exercise.

Over the years support and footrests have been designed for various purposes. For example, U.S. Pat. No. 621,098 discloses a foot rest that has a pair of curved cushions mounted on a rocking frame. Although not designed for exercise, the device could be used to support legs during pushups. However, the rocking feature makes the device unstable for proper exercise.

Several devices, such as U.S. Pat. Nos. 4,2332,381, 5,330,408, and 5,582,565 teach devices in which the user can be supported by placing hands and feet on the device. All of these devices require that the hands and feet contact solid surfaces in the way they would if they were not using the device. These devices, therefore, provide no relief for those with the conditions mentioned above.

U.S. Pat. No. 4,826,151 teaches a unique device for pushups and hand walking. It is a frame that has rigid ankle supports. The frame is height adjustable, but has a fixed width. Moreover, the supports are fixed and cannot be adjusted. Finally, the design has wheels that can be used to walk the device around. While limited to unique purposes, such a device can be dangerous in that it can be unstable. A wrong movement could cause the device to slip and fall, possibly causing injury.

U.S. Pat. No. 6,695,754 teaches a device that also supports ankles. This device has a folding frame that has a lower base support and a pair of vertical arms. The vertical arms have slots to receive a pair of ankle pads that can rotate freely in the frame. This device has a number of drawbacks. First, the lower frame is lightweight tubing, which may be unstable in some instances. The vertical arms have no ability to adjust in width, which limits the device to essentially an ankle support. For example, doing the plank exercise, as discussed above, is really not possible with this device as it is too narrow for comfortable use. The freely rotating ankle supports may be somewhat more comfortable, but may also cause stability problems.

Note that both U.S. Pat. Nos. 4,826,151 and 6,695,754 suffer from another limitation. They both have ankle supports that are positioned on a single horizontal plane. There is no way to adjust the pads so that they are at two different heights.

BRIEF DESCRIPTION OF THE INVENTION

The instant invention overcomes these difficulties. It is a foot/leg/arm rest that is fully height and width adjustable. In addition, the support cups can be positioned over a wide range of fixed angles to accommodate any user. The supports have a wide base that provides strong, firm and stable support for the device when it is used. This reduces the chances that the unit will move or roll during use.

The invention consists of a base that has two horizontal end members and a central connecting track. Two vertical post supports are positioned in the track and are slidably installed so that they can be positioned at any desired location within the track. In fact, one of the posts can be removed if desired so that only one post is in use. Each post is height adjustable independent of the other. This allows that supports to be positioned at two different levels, if desired. Each post has a support secured to it using a bracket that can be set to a wide range of angles. Again, unlike the prior art, each support is independently adjustable.

FIG. **6*a*** is a front view of the device with the optional exercise band clips installed in the two horizontal end members and footplate in place and with exercise bands installed.

Figure 7:
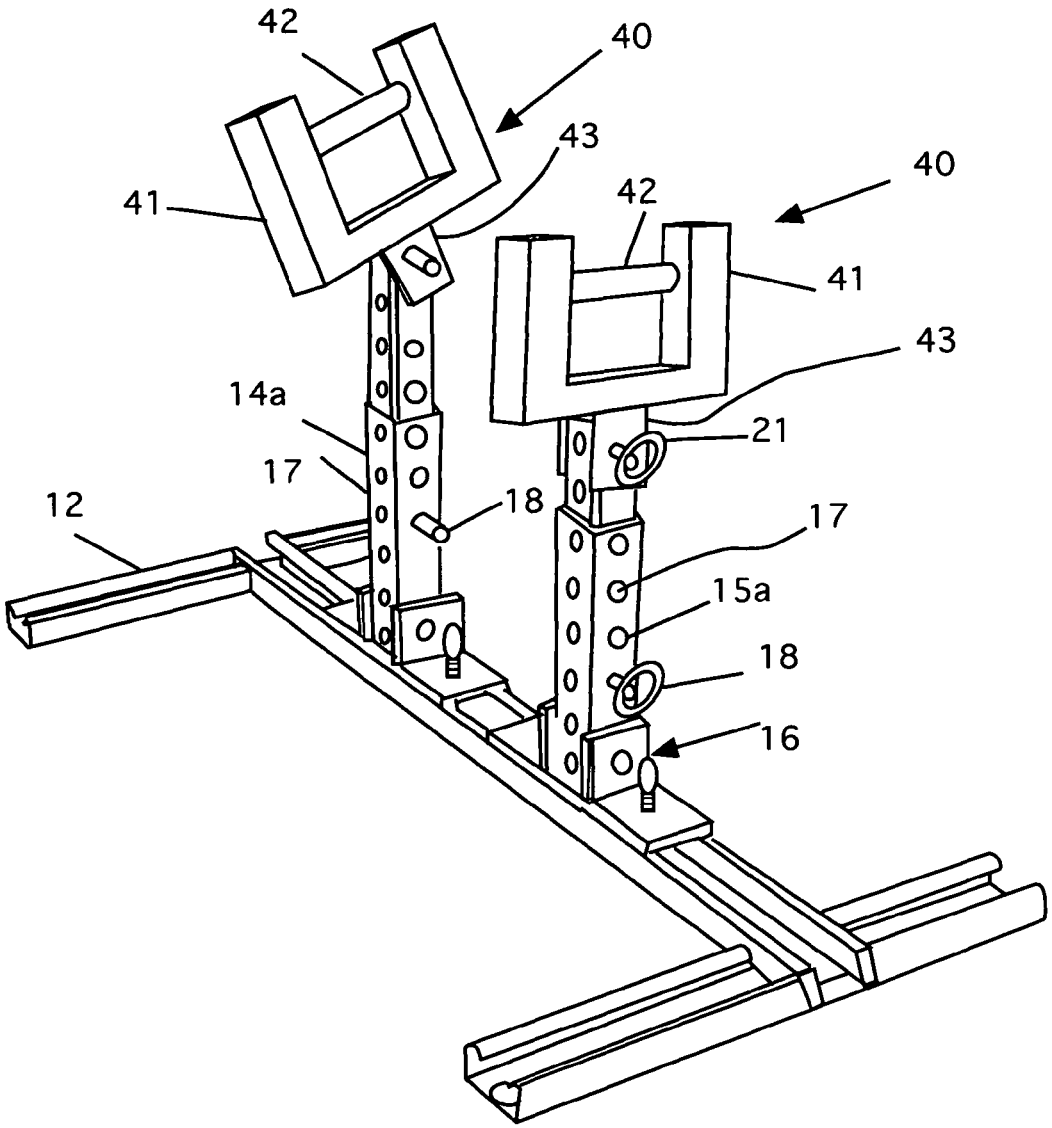

FIG. 7 is a side perspective view of the invention as an alternative embodiment showing optional handgrips in place.

Figure 8:
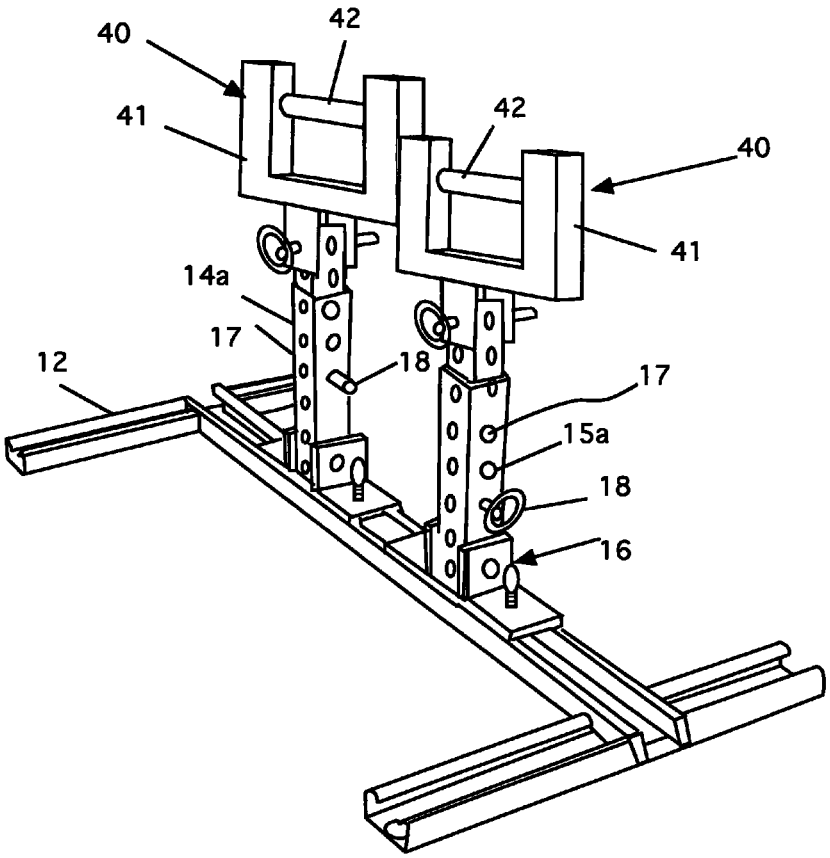

FIG. 8 is a side perspective view of the invention showing the optional handgrips in place and rotated 90 degrees.

DETAILED DESCRIPTION OF THE INVENTION

Figure 1:
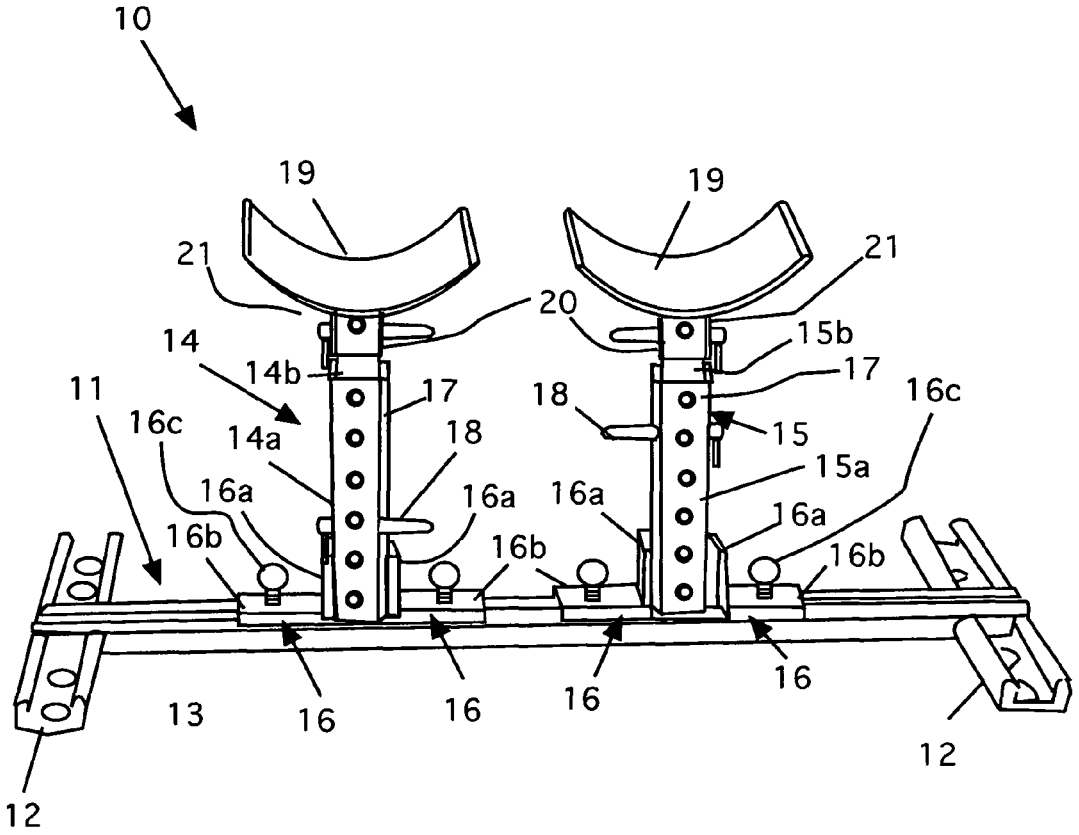
FIG. 1 is a front perspective view of the invention

Referring now to FIG. 1, a front view of the invention 10 is shown. The invention consists of a base 11 that has two horizontal end members 12 and a central connecting track 13. Two vertical support posts 14 and 15 are positioned in the central connecting track and are slidably installed in the central connecting track so that they can be positioned at any desired location within the central connecting track. In fact, one of the vertical support posts can be removed if desired so that only one vertical support post is in use. The vertical support posts 14 and 15 are secured in the central connecting track using locking brackets 16. These locking brackets have a vertical portion 16*a* that are secured to the sides of the outer portion of the vertical support posts and a horizontal portion 16*b*. The horizontal portions 16b have thumb screws 16*c* that are used to secure the locking brackets to the central connecting track in the desired location. Once tightened, vertical support posts 14 and 15 are firmly help in place.

Each of the vertical support posts 14 and 15 have an outer portion 14*a* and 15*a* and an inner portion 14*b* and 15*b*. (See also FIGS. 2 and 3). A series of holes 17 are formed in both the inner and outer portions of the vertical support posts. These holes allow the vertical support posts to be height-adjustable. When the inner portion is at the desired height, it is secured with a vertical support post pin 18 that passes though both the inner and outer portions as shown.

Support pads 19 are attached to the tops of the vertical support posts using a cap bracket 20 that is secured to the inner portion of each vertical support post with a support pad pin 21. Note that the support pads 19 are shown curved to better fit the limbs of the user. The support pads can also have a thin layer of padding, if desired for additional comfort.

Figure 2:
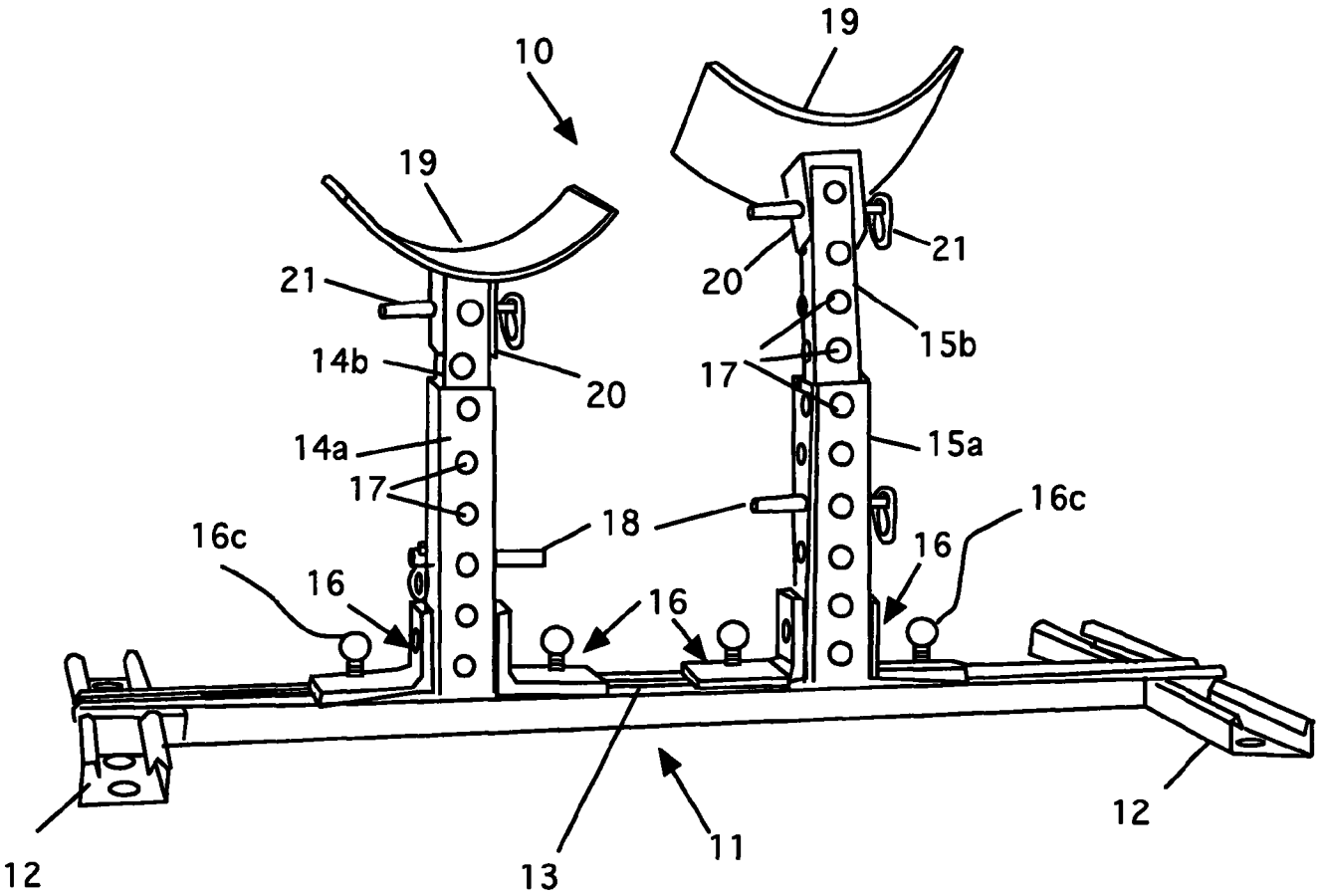
FIG. 2 is a front perspective view of the invention showing one vertical support at a different height from the other, and the leg pad tilted.

FIG. 2 is a front perspective view of the invention showing one vertical support at a different height from the other, and the leg pad tilted.

Figure 3:
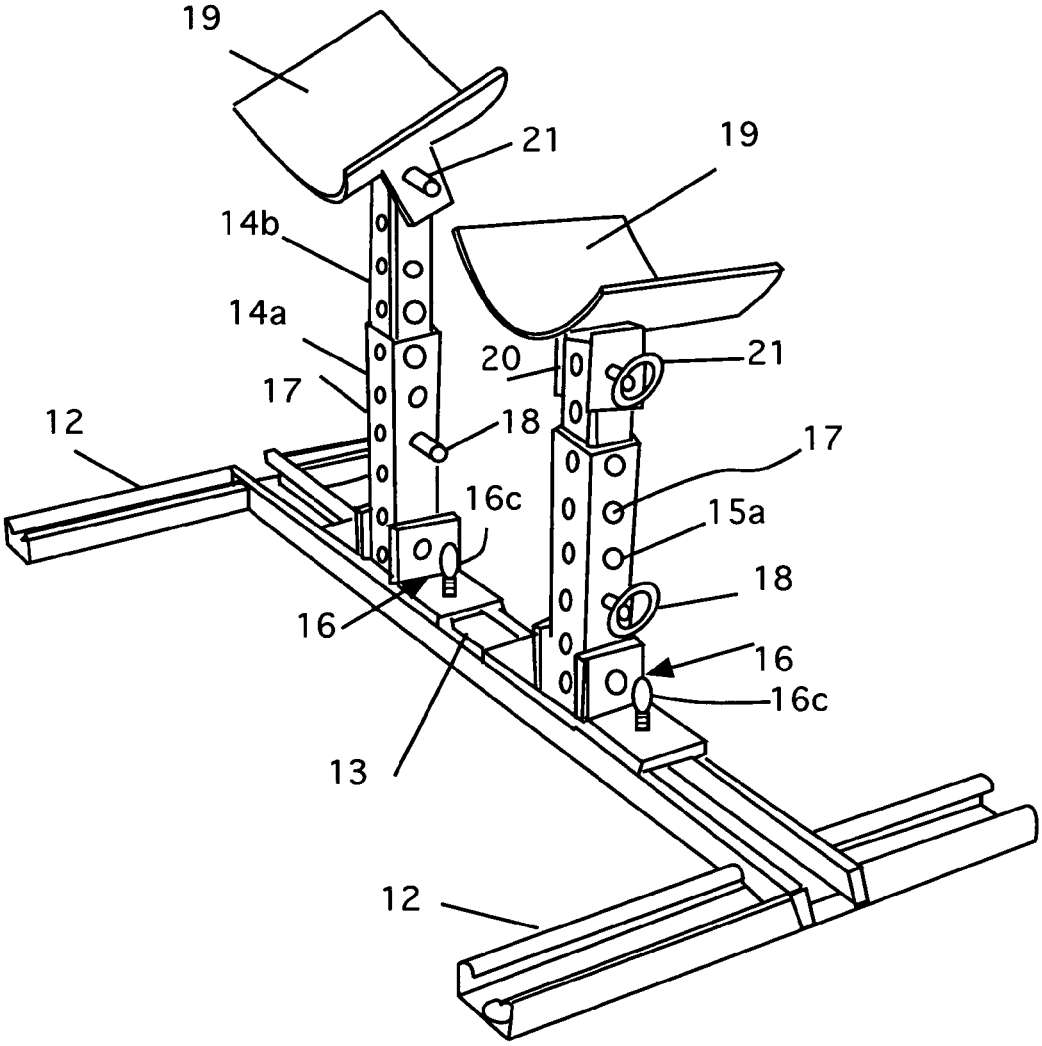
FIG. 3 is a side perspective view of the invention showing one vertical support at a different height from the other, and both leg pads tilted.

FIG. 3 is a side perspective view of the invention showing one vertical support post 15 at a different height from the other 14, and both support pads 19 tilted at different angles with respect to the vertical support posts. Note that each vertical support post, 14 or 15, is independently height-adjustable, which allows the supports to be positioned at two different levels, if desired. FIG. 2 also clearly shows the inner portion 15*b* of vertical support post 15 in a raised position. As noted above, at the top of each vertical support post is a cap bracket 20 that is secured to the inner portion of each vertical support post with a support pad pin 21. Pins are used the preferred embodiment because they require no tools to use, but any other suitable fasteners can be used. Note that the cap brackets are open in the back and front (see, e. g., FIG. 3). This allows the cap brackets to tilt forward or back to any desired angle over almost a full 180 degrees. Obviously, during use, the preferred angles are limited to a range of between about 45 degrees forward or back. This adjustment is made by loosening the fasteners, tiling the support pad to the desired angle and then retightening the fasteners to secure the pad for use.

Figure 4:
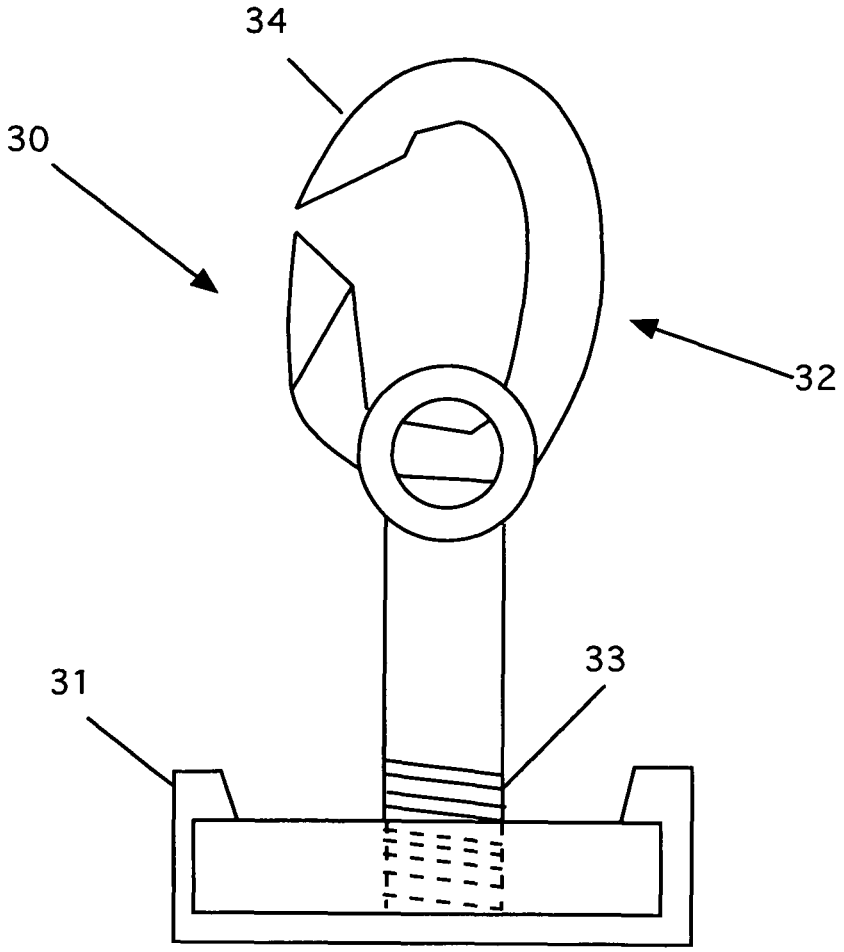
FIG. 4 is a side view of an optional clip for use with exercise bands.

FIG. 4 is a side view of an eyebolt clip assembly 30 as an optional embodiment for use with resistance bands. As discussed below, the device can be used to do exercises using resistance bands. To use the bands, the eyebolt clip assemblies 30 are installed in lieu of the vertical support posts. The eyebolt clip assembly 30 has a base portion 31 that slides into the central connecting track 13. Once positioned, the clip portions 32, which have threads 33, are screwed down until they lock the base portions 31 in place. The threads 33 can be considered as a means for temporarily securing any of the eyebolt clip assemblies in the base 31. At the top of the clip portion 32 is a latch clip 34 that has an opening 35 into which the resistance bands 36 (see FIG. 6).

Figure 5:
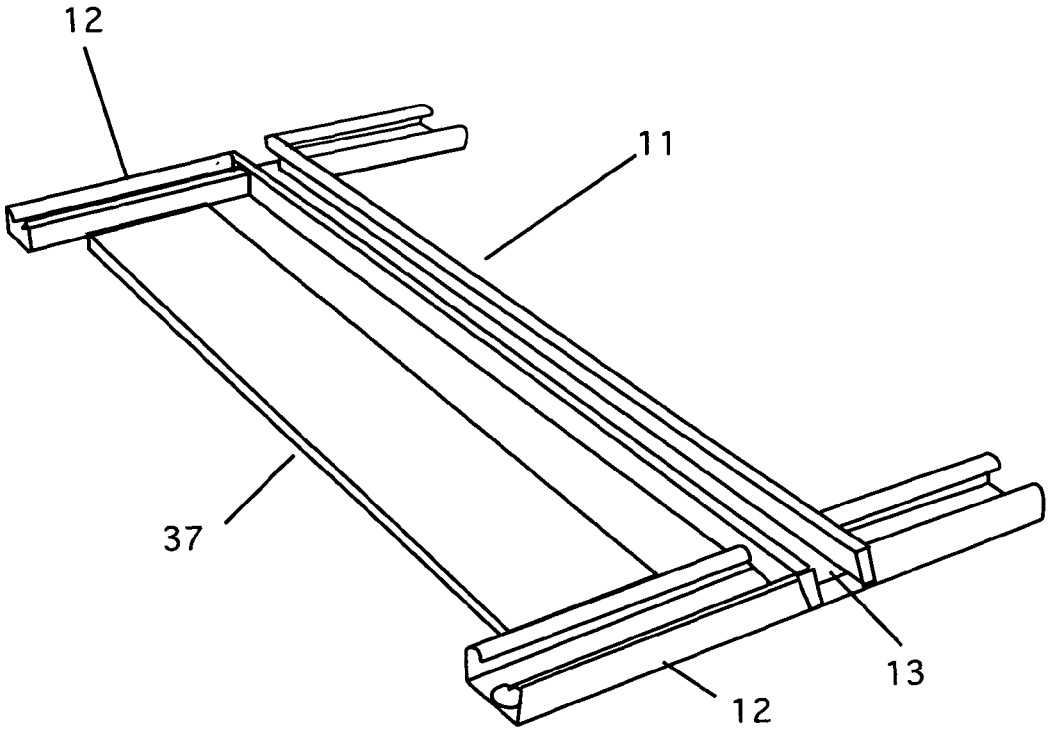
FIG. 5 is a detail view of the device with a footplate, used with the optional clips in place.
Figure 6:
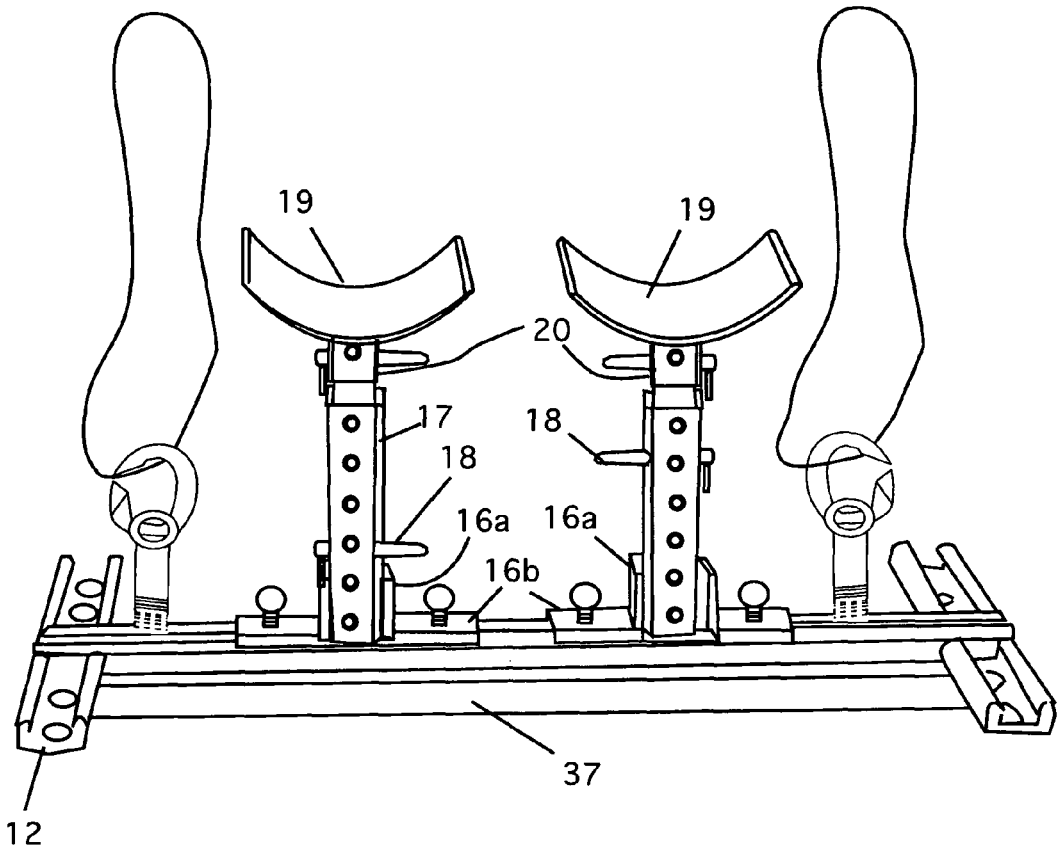
FIG. 6 is a front view of the device with the optional exercise band clips installed in the main track and footplate in place and with exercise bands installed.
Figure 6A:
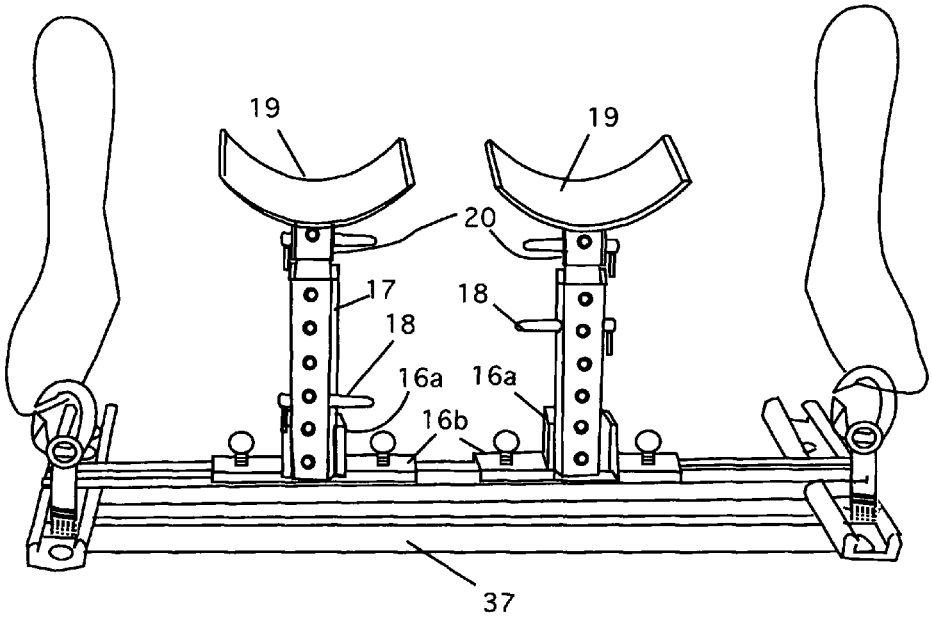

FIG. 5 is a detail view of the base 11 with a footplate 37 in place. Here, the vertical support posts 14 and 15 have been removed from the base 11. The footplate 37 is positioned between the front portions of the horizontal end members 12 and secured to them. The footplate 37 is used to hold the frame down when the user is using the resistance bands. When the resistance bands are used, the user stands on the footplate to prevent the frame from lifting. FIG. 6 is a front view of the lower track with the eyebolt clip assemblies installed in the central connecting track 13 and footplate 37 in place and with resistance bands 36 installed. Here, the eyebolt clip assemblies 30 are installed in the track with the vertical support posts in place. In this way, the resistance bands 36 can be used without having to hold the bands with the user's feet (where they can easily slip off)-as is the normal practice for using these bands. It is also unnecessary to remove the vertical support posts when using the resistance bands. Of course, if the user desires, the eyebolt clip assemblies 30 can be installed in the track with the vertical support posts removed-using just the base as shown in FIG. 5, although that is not preferred. Alternatively, the eyebolt clip assemblies 30 can be placed in the two horizontal end members as shown in FIG. 6*a*. Either of these configurations extends the versatility of the device.

Resistance band exercises are ideal for home exercise programs and can be used for cardiovascular conditioning as well as for strengthening specific muscle groups. Some of the exercises that can be used with the eyebolt clips and resistance bands include resistance band squats, bent over rowing, diagonal wood chops, triceps extension, lateral rows and bicep curls.

One of the key exercises that can be done with this device is an exercise called "the plank". The plank is an isometric exercise that helps build endurance in a user's entire core—rectus abdominus, oblique's, lower back and stabilizing muscles. The exercise itself can cause damage to the elbow if the elbow is not properly protected from the floor. While performing the plank exercise one normally has the elbows directly in contact with the floor, the floor might have carpet or a slight covering on it. This condition can cause discomfort in the elbows while in direct contact with the floor performing the exercise and could cause joint pain or damage the elbows. Using the instant invention and placing the forearms in the padded cups takes away the discomfort of the contact with the floor. The exercise can be performed in a horizontal plane or used with an incline when using the device. This takes the direct floor contact away from the elbows and allows the exercise to be performed focusing on the end results instead of the pain on the elbows due to the floor contact.

Another option allows the user to grip handgrips directly when performing push-up type exercises. In this embodiment, handgrips are installed in place of the curved pads. FIG. 7 is a side perspective view of the invention as an alternative embodiment showing handgrips 40 in place. In this figure, the frame and vertical support posts l4 and 15 are set up as before. However, the support pads 19 have been removed and handgrips 40 have been added. The handgrips 40 have an open-topped generally rectangular frame 41 and cylindrical grip portions 42. The handgrips are secured to the vertical support posts using brackets 43 and support pad pins 21. In this way, the handgrips can be angled front to back, as desired. FIG. 8 shows the handgrips 40 installed on the vertical support posts, rotated 90 degrees from the orientation shown in FIG. 7. This option allows the user to grip the handgrips in this-manner as well. Note that in this position, the handgrips 40 can be angled from side to side, as desired.

Note also that both the curved pads and the handgrips can be considered as "exercise supports" for the purposes of this invention.

Using this platform a user can perform any number of exercises, including push-ups with the legs being supported, the "plank" in which one has the elbows supported by the device instead of having them on the floor, push-ups using the hand grips, and numerous exercises using resistance bands. Thus, this invention provides a safe, comfortable and versatile platform for a user's exercise needs.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A foot, leg, and arm support apparatus for exercise comprising:

a base, having two sides and a latitudinal center, the base being adapted to rest stably on a table or floor such that the majority of one side of the base is resting on the table or floor, the base having a track portion positioned on the latitudinal center of the base;

a first vertical support post, slidably installed in the track portion of the base;

a second vertical support post, slidably installed in the base, and being in a spatial relationship with the first vertical support post, wherein the second vertical support post is independently movable from the first vertical support post;

a first fastener for temporarily locking the first vertical support post in one position in the track portion of the base;

a second fastener for temporarily locking the second vertical support post in one position in the track portion of the base;

a first exercise support, attached to the first vertical support post, the first exercise support having a curved surface adapted to conform to a user's curved body part, the first exercise support being positioned on the first vertical support post such that a longitudinal axis of the first exercise support is substantially perpendicular to the track portion, wherein, when a longitudinal axis of the user's body part is positioned on the first exercise support, the user's body part is substantially perpendicular to the track portion, and further wherein the first exercise support is pivotably attached to the top of the first vertical support post;

a third fastener for temporarily locking the first exercise support in a fixed position on the first vertical support post;

a second exercise support, attached to the second vertical support post, the second exercise support having a curved surface adapted to conform to a user's curved body part, the second exercise support being positioned on the second vertical support post such that a longitudinal axis of the second exercise support is substantially perpendicular to the track portion, wherein, when a longitudinal axis of the user's body part is positioned on the second exercise support, the user's body part is substantially perpendicular to the track portion, and further wherein the second exercise support is pivotably attached to the top of the second vertical support post; and a fourth fastener for temporarily locking the second exercise support in a fixed position on the second vertical support post.

2. The apparatus of claim 1 wherein the first and second vertical support posts have an adjustable height.

3. The apparatus of claim 2 wherein the height of the second vertical support post is adjustable independently from the height of the first vertical support post.

4. The apparatus of claim 1 wherein the base further comprises:

a first side member having an outer edge, an inner edge, a longitudinal center portion, and a latitudinal center; and a second side member also having an outer edge, an inner edge, a longitudinal center portion, and a latitudinal center, the second side member being spaced apart from the first side member, the second side member aligned such that the inner edge of the first side member is opposed to the inner edge of the second side member, wherein the track portion is attached to the inner edges of the first and second side members at their latitudinal centers, and further wherein the combination of the first and second side members and the track portion forms the base in an "H" shape.

5. The apparatus of claim 4 further comprising:

an eyebolt clip assembly, installed in the longitudinal center portion one of the side members;

a fifth fastener for temporarily securing the eyebolt clip assembly in the longitudinal center portion one of the side members;

a resistance band installed in the eyebolt clip assembly; and a footplate removably installed between the side members.

6. The apparatus of claim 5 further comprising:

a second eyebolt clip assembly installed in the longitudinal center portion the other of the side members;

a sixth fastener to temporarily secure the second eyebolt clip assembly in the longitudinal center portion other of the other of the side members; and a second resistance band installed in the second eyebolt clip assembly.

7. The apparatus of claim 1 further comprising:

an eyebolt clip assembly, installed in the base;

a fifth fastener to temporarily secure the eyebolt clip assembly in the base;

a resistance band installed in the eyebolt clip assembly; and a footplate positioned abutting the base.

8. The apparatus of claim 7 further comprising:

a second eyebolt clip assembly installed in the base;

a sixth fastener to temporarily secure the second eyebolt clip assembly in the base; and a second resistance band installed in the second eyebolt clip assembly.

9. The apparatus of claim 1 further comprising:

an eyebolt clip assembly installed in the track portion;

a fifth fastener to temporarily secure the eyebolt clip assembly in the track portion;

a resistance band installed in the eyebolt clip assembly; and a footplate abutting the base.

10. The apparatus of claim 9 further comprising:

a second eyebolt clip assembly installed in the track portion;

a sixth fastener to temporarily secure the second eyebolt clip assembly in the track portion; and a second resistance band installed in the second eyebolt clip assembly.

* * * * *